US005674360A

United States Patent [19]

Wyllie

[11] Patent Number: 5,674,360

[45] Date of Patent: Oct. 7, 1997

[54] METHOD AND APPARATUS FOR STEAM PACKING/PRESTEAMING A BATCH DIGESTER

[75] Inventor: Duane R. Wyllie, Mobile, Ala.

[73] Assignee: International Paper Company, Purchase, N.Y.

[21] Appl. No.: 457,763

[22] Filed: Jun. 1, 1995

[51] Int. Cl.[6] ..... D21C 7/06

[52] U.S. Cl. ..... 162/52; 162/68; 162/238; 162/246

[58] Field of Search ..... 162/72, 76, 238, 162/250, 17, 68; 422/232

[56] References Cited

U.S. PATENT DOCUMENTS

| | | | |
|---|---|---|---|
| 1,593,147 | 7/1926 | Svensson | 462/246 |
| 1,813,205 | 7/1931 | Scholz et al. . | |
| 1,915,410 | 6/1933 | Decker . | |
| 2,029,086 | 1/1936 | Svensson | 92/7 |
| 2,901,039 | 8/1959 | Salmonson | 162/246 |
| 3,928,123 | 12/1975 | Marks | 162/15 |
| 4,238,285 | 12/1980 | Zucker | 162/242 |
| 5,547,546 | 8/1996 | Prough et al. | 162/238 |

FOREIGN PATENT DOCUMENTS

| | | |
|---|---|---|
| 581548 | 8/1959 | Canada . |
| 1154622 | 10/1983 | Canada . |

OTHER PUBLICATIONS

Gary Smook, "Handbook for P & P Tech", 2nd Ed, 1992, pp. 80, 84–89.

*Primary Examiner*—Donald E. Czaja
*Assistant Examiner*—Dean T. Nguyen
*Attorney, Agent, or Firm*—Luedeka, Neely & Graham, P.C.

[57] ABSTRACT

A batch digester loading method is described wherein a flow stream of steam enters the digester near the bottom thereof as a flow stream of wood chips enters through the top filler neck. Steam flow begins in the bottom portion of the digester at an initial, reduced flow rate after a minimum chip mass is accumulated. Steam flow is thereafter increased at a rate proportional to the inflow rate of chips.

14 Claims, 1 Drawing Sheet

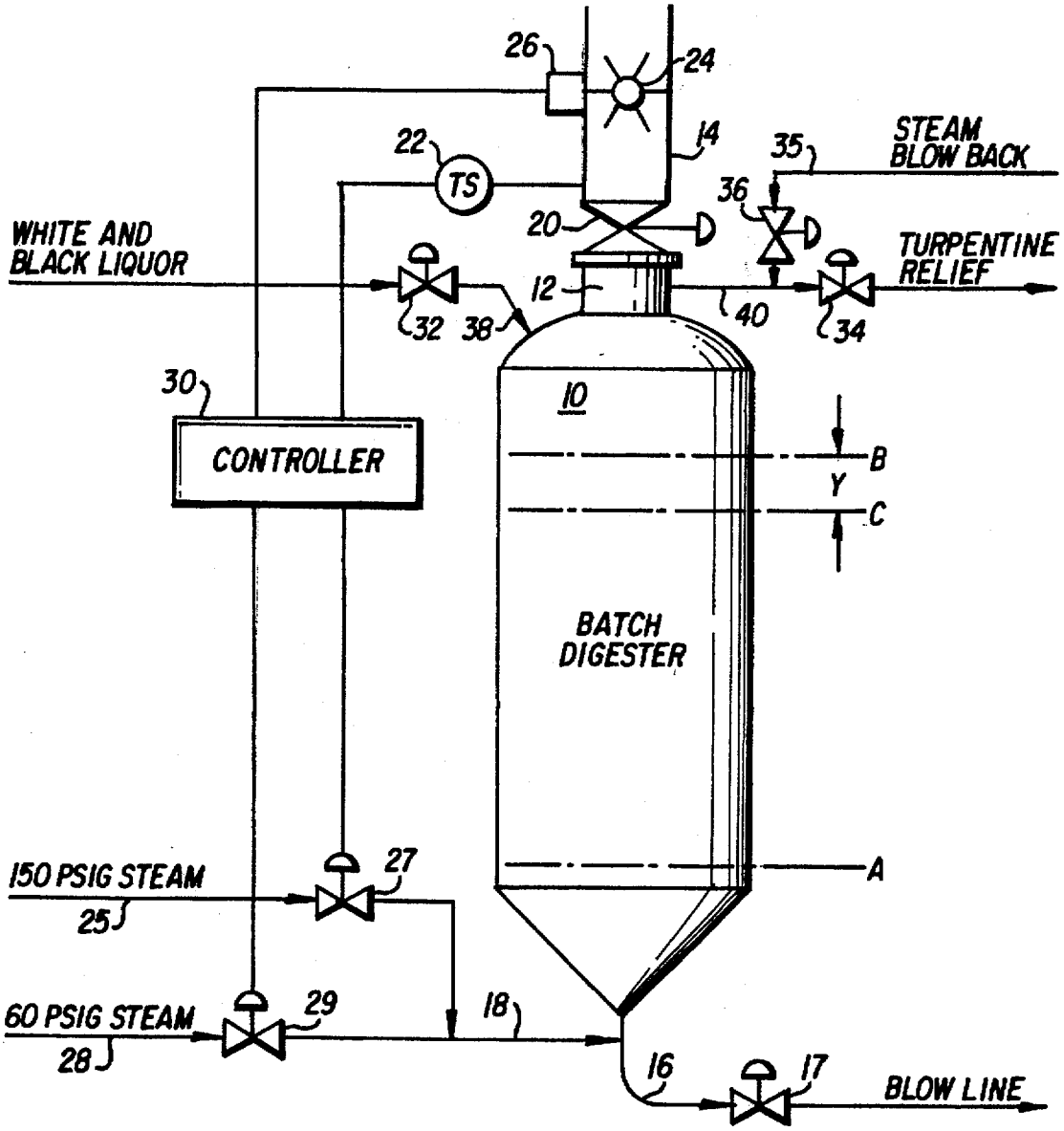
26
24
14
22
TS
35
STEAM BLOW BACK
36
20
WHITE AND BLACK LIQUOR
12
TURPENTINE RELIEF
32
38
40
34
30
10
CONTROLLER
B
Y
C
BATCH DIGESTER
A
150 PSIG STEAM
25
27
60 PSIG STEAM
28
29
18
16
17
BLOW LINE

METHOD AND APPARATUS FOR STEAM PACKING/PRESTEAMING A BATCH DIGESTER

BACKGROUND OF THE INVENTION

The present invention relates to wood pulping and papermaking. Specifically, the invention relates to a process and corresponding apparatus for more efficiently producing wood pulp from a batch type digester.

Each digester in a pulp mill represents an enormous capital investment for utility support and environmental protection. It is of paramount importance, therefore, that pulp production from each digester be sustained at the greatest possible rate consistent with the wood species used and the pulp characteristics desired. Although several types of continuous digesters are well developed for producing certain kinds of pulp, the batch cycled digester remains in wide commercial use due to its adaptability to the widest range of products and controllability for uniform quality of those products. In terms of production rate, however, a large percentage of the batch digester production cycle, from batch-blow to batch-blow, is spent in the loading and preheating intervals. Since total cycle times run in the range of 60 to 185 minutes, any reduction of only a few minutes is significant when it is considered that most pulp mills operate continuously and the saving will be repeated several times a day with the end result of more product per unit of time.

Wood pulping digesters of the batch cycled type are normally elongated, vertical axis pressure vessels having a filler neck of reduced sectional area at the top and a product blow line from the bottom. A capping valve in the filler neck is selectively opened to admit a wood chip charge into the pressure vessel and closed to secure steam pressure for the designated chip cooking time.

According to a prior art practice, as chips enter the vessel from the filler neck, chip packing steam is admitted to the upper portions of the pressure vessel at a skewed angle to the vessel axis for the two-fold purpose of 1) leveling the chip sectional distribution as the chip charge accumulates and 2) heating and presteaming of the chips as the charge accumulates.

As the top down directed steam flow distributes the incoming chip charge, air drawn down through the digester filler neck with the chips is discharged through the digester circulation screen and/or through vent taps at the bottom of the digester.

Presteaming wood chips is known to reduce knot and shive generation by improving the impregnation of liquor into the chips, which increases the digester screened yield. Also, steam packing plus presteaming reduces the time to temperature, the time at temperature, alkaline charge, and eliminates false digester pressure.

Uniform sectional distribution of the chips makes it possible for the cooking liquor to circulate evenly within the digester for uniform chip penetration resulting in a high quality pulp having few shives and knots.

Bottom up directed steam flow during the chip packing and heating interval has previously been considered unsafe as impossible to control. Prior experiences and attempts have resulted in violent chip discharges through the filler neck.

It is, therefore, an object of the present invention to increase the productivity of batch cycled wood pulp digesters.

Another object of the present invention is to increase the mass of wood chips loaded into a digester for each cooking cycle.

Also an object of the present invention is to reduce the variations in wood chip mass charged into a digester between successive cooking cycles.

A further objective for the present invention is to reduce the required presteaming time for a digester chip charge.

Another objective of the present invention is to reduce the chemical alkali charge in which a chip batch is cooked.

A still further object of the present invention is to reduce the digester cycle time by reducing the time to temperature and the time at temperature.

Another objective of the present invention is to increase screened yield of a digested chip batch by knot and shive reduction.

Another object of the present invention is to improve the consistency of chip delignification as is represented by a reduction in the standard deviation of measured Kappa Number values.

Additional objects of the present invention are to improve pulp uniformity and strength by reducing the alkali charge and cooking temperature.

Another object of the present invention is the reduction of recovery boiler solids, pulp dirt, and bleach plant chemical consumption.

SUMMARY OF THE INVENTION

With regard to the foregoing and other objects and advantages, the present invention is directed to a digester steam packing/presteaming sequence which, in accordance with its more general aspects, comprises loading chips into a digester to accumulate a preliminary chip mass in the digester sufficient to restrain and condense approximately ⅓ to ½ of the maximum flow rate of steam directed into the accumulated chips in the bottom of the digester. With the preliminary chip mass in place, steam flow is then initiated and increased proportionately to the chip bed accumulation, preferably at the maximum rate which is sufficient to insure full condensation of the steam flow by the chip bed mass.

In accordance with one exemplary embodiment of the invention, a digester packing/pre-steaming sequence is provided for a 4,500 $ft^3$ to 6,500 $ft^3$ digester whereby substantially all digester steam flow is terminated while the first 5 to 13 green tons (G.T.) of chips are charged. With a minimum chip charge in the digester, steam flow is started from the bottom at a rate of 20,000 to 30,000 pounds per hour.

As the chip charge accumulates, the steam flow rate is increased until reaching a rate of about 70,000 pounds per hour. Such steam flow rate increase is modulated by the rate of chip condensation. The quantity of chips in the digester preferably should be capable of condensing all the steam added to the digester from the bottom. Also, the chip mass in the digester must be adequate to prevent the steam force from blowing chips out of the digester.

A temperature sensor is positioned in the chip charging chute as a source of a steam valve control signal. Should steam break through the chips and exit the digester through the filler neck, the temperature sensor will detect the significant temperature rise from the steam and shut the steam supply valve.

For digesters in the size range of 4500 to 6500 $ft^3$, the steam flow rate in pounds per hour is preferably modulated according to the relationship:

$$\text{Steam Flow, lb/hr} = (\text{Chip Weight, G.T.} + 4.79) \div (0.000896)$$

BRIEF DESCRIPTION OF THE DRAWING

The single FIGURE of the drawing illustrates a piping and control schematic of the invention physical arrangement.

DESCRIPTION OF THE PREFERRED EMBODIMENT

Referring now to the single figure of the drawing, there is indicated at 10 a 150 psia rated, elongated, cylindrical pressure vessel exemplary of an apparatus for practicing the present invention. The upper end of the vessel 10 is closed by a domed end-cap having a filler neck cylinder 12 of reduced circular section, usually 2 ft. to 4 ft diameter, projecting axially therefrom. At the bottom end, the vessel is closed by a generally funneled configuration having a blow-line conduit 16 issuing substantially along the funnel axis and flow controlled by a motor valve 17.

A quantity of wood chips or other appropriate cellulosic fiber source is charged into the vessel 10 interior through a chip chute or channel 14 past a capping valve 20 which seals at least 150 psig steam pressure within the vessel 10. Preferably, a chip weight or volume flow meter 24 is disposed in the chip supply channel 14 as the source of a chip flow rate related signal from the meter transducer 26 to a process controller 30.

Also disposed within the chip supply channel 14 is a temperature sensor 22 responsive to temperature within the channel of the character that is indicative of steam escaping from the vessel 10 interior. Sensor 22 is constructed to transmit a signal to the controller 30 in the event of steam escape from the vessel 10 into the chip supply channel.

Operatively connected to the upper or bottom end of the vessel 10 are one or more liquor lines 38 controlled by respective valves 32, preferably remote operated valves. These liquor supply conduits are connected to admit processing chemical onto a chip charge such as those blends characterized by the industry lexicon as white and black liquor.

In internal flow communication with the upper portion of the filler neck 12 below the capping valve 20 is a turpentine relief conduit 40 which extracts valuable product vapors such as turpentine for condensation and sale. Such extraction is controlled by the two valves 34 and 36. Steam blow-back conduit 35, controlled by valve 36, provides a source of steam pressure to expel the chips, fines and fiber that collect on the separator strainer located in conduit 40.

Steam conduit 18 may be alternatively supplied with medium (approximately 160 psig) and low grade (approximately 60 psig) steam via conduits 25 and 28 controlled by valves 27 and 29, respectively. Motor valves 27 and 29 preferably are operatively responsive to the controller 30 and signals from the chip meter transmitter 26 and the supply channel temperature sensor 22. It should also be understood that the controller 30 may be responsive to signal sources other than or additional to those of transmitter 26 and temperature sensor 22.

As an overriding steam control concern, preheating and distribution steam temperature should not exceed 400° F. out of concern for the resulting pulp quality and strength. Wood cellulose deteriorates rapidly above about 400° F. Normally, digester steam temperatures are in the range of 330° F. to 360° F.

In the operative context of the aforedescribed equipment, a chip cooking cycle according to a preferred embodiment of the invention proceeds substantially along the following event sequence.

With the valves 17, 27, 29, 32, 34 and 36 closed, capping valve 20 is opened to admit a measured chip flow rate into the digester 10. Upon the internal accumulation of a lower threshold chip quantity to the level A, either or both steam valves 27 or 29 are opened to admit an initial steam flow rate of about ⅓ to ½ of the full flow rate.

A "full" steam flow rate to a particular digester is a highly variable value concluded by many factors. An initial or primary design factor is the volumetric size of the digester. However, the value may also be influenced by the total digester volume distributed among a multiplicity of individual digesters in a pulp plant as a function of the steam plant generation capacity. More particularly, the full steam flow rate available to a digester will depend on the size of the steam generation plant, the total volumetric steam demand from the supply system at the moment and the line capacity to carry that demand. All of these factors considered, a reasonably reliable full flow rate to a particular digester will be provided as a function of the digester volume.

It is not believed necessary to know precisely the physical location of the chip level B. Actual practice of the invention only requires that a sufficient chip plug depth is in place when the steam valves are opened to contain and condense the initial steam flow rate. By "sufficient" chip plug is meant that a minimum or threshold chip mass relationship to the initial steam flow rate is present to: (1) prevent chips that form the plug from being blown from the digester through the filter neck; (2) prevent steam from short-circuiting the chip plug by channeling through or around it; (3) prevent a fluidization or suspension of the accumulating chip plug and, (4) entirely condense the steam-input.

This procedure and flow sequence is to be understood in the context of a continuously transitioned material flow and blending process. When chip flow into the digester begins, it continues at a substantially full flow rate until the full chip charge is in the digester. Steam flow into the bottom of the digester is coordinated with this continuous chip in-flow. Accordingly, at a known chip flow rate (weight or volume per unit of time), the initial steam flow rate begins at the appropriate moment after chip in-flow begins. There normally is no hesitation or change in the chip in-flow rate as the steam flow starts. The chip bed continues to steadily accumulate the combined mass of the steam and the chips since all the steam is condensed upon the chips.

As the chip bed grows in mass, the steam flow rate is correspondingly increased to continue the full condensation, non-channeling and non-fluidizing strategy until the maximum steam flow capacity is attained or all the chips of a charge are in the digester.

For digesters in the size range of 4,500 $ft^3$ to 6,500 $ft^3$, a chip charge of 5 to 13 tons of "green" (50% moisture content) chips will restrain and condense an initial steam flow of about 20,000 to 30,000 lb/hr. Of course, a "trickle" flow of steam may be started with initial chip delivery but in most pulping facilities, the minimum chip quantity is deposited in the digester with such rapidity that trickle flow regulation of steam up to a containable ⅓ to ½ flow rate is rarely justified. In either case, steam flow is then increased at a steady or ramped rate corresponding to the chip influx rate and consistent with the functional result of condensing all steam injected into the vessel bottom by conduit 18 within the accumulating chip bed. For digesters in the 4,500 $ft^3$ to 6,500 $ft^3$ range, the controller 30 may be programmed to increase the steam flow along with the chip bed increase approximately according to the following relationship:

$$\text{Steam Flow, lb/hr} = (\text{Chip Weight, GT} + 4.79) \div (0.000896)$$

This relationship is suitable for a full flow rate of about 70,000 lb/hr. into 52 to 60 GT of chips and continues until all chips for a charge are in the digester or when the designated presteaming period is complete, usually a period of less than 3 minutes.

As the chips and steam combine, the chip surface level B rises up the digester height followed by a plug zone Y of chips above a steam saturated chip face C. Below the level B, which is actually a transitional zone, the chips are steam condensate saturated and are above the temperature of 220°. Under these conditions, the chips are soft, plastic, pliable and readily compacted by the weight of the chip charge overburden.

Accordingly, both compaction and presteaming of the chip charge are accomplished simultaneously.

During this combined chip presteaming and steam packing period, the temperature sensor 22 is calibrated to signal the presence of steam above the capping valve 20. In such an event, the appropriate signal is transmitted to the controller 30. Responsively, other control programs are overridden in favor of a valve closure command to steam valves 27 and 29 to immediately terminate steam flow from the conduit 18.

With the chip charge and presteaming period complete, the steam valves 27 and 29 are closed as is the capping valve 20. In this state, the relief valve 34 and liquor valve 32 are opened to deliver a complete liquor charge into the chip bed.

Having received a complete liquor charge, the valve 32 is closed and the low pressure steam valve 29 and later, medium pressure steam valve 27 are opened to raise the charged digester to the designated cooking temperature and pressure whereupon all valves except 34 are closed for the transpiration of the designated cooking time. When the cook is complete, the blow valve 17 is opened to expel the digester contents explosively.

Having described the preferred embodiments of my invention,

I claim:

1. A method of charging wood chips into a batch digester comprising the steps of: (a) loading wood chips into a digester through an opening therein (b) to form an initial accumulated threshold mass of chips at the bottom of the digester, starting an initial steam flow into the accumulated threshold mass of chips, said initial steam flow entering the chip mass proximate of the chip mass bottom adjacent the bottom of the digester at a flow rate substantially less than a maximum steam flow rate, said threshold mass of chips being sufficient to substantially contain and condense said initial steam flow and, thereafter, while (c) continuing to load chips in the digester, and (d) increasing steam flow into said chip mass at a rate proportional to the chip mass accumulation rate.

2. A method of loading wood chips into a batch digester as described by claim 1 further comprising the step of (e) monitoring the temperature of gas flowing through said opening from the interior of said digester, (f) generating a control signal responsive to a set-point of said monitored temperature and (g) terminating said steam flow in response to said control signal.

3. The method of claim 1 wherein the rate of increase of steam flow into the chip mass is controlled to provide a maximum rate which will fully condense into the accumulating chip mass and at the same time avoid channeling of steam through the chips or blowing of chips from the opening in the digester.

4. A method of loading wood chips into a batch digester as described by claim 3 wherein said initial steam flow is about ⅓ to ½ of said maximum steam flow.

5. The method of claim 1 wherein the rate of chip mass accumulation is maintained substantially constant and substantially without interruption throughout the loading process.

6. The method of claim 1 wherein the steam flow rate is increased substantially immediately after the initial steam flow is started.

7. A method of loading wood chips into a batch digester as described by claim 1 wherein said steam flow increase is regulated substantially according to the relationship:

$$\text{Steam Flow, lb/hr}=(\text{Chip Weight, G.T.}+4.79)\div(0.000896),$$

wherein G.T. represents the mass in green tons of chips charged into the digester through the opening.

8. A method of operating a batch loaded wood chip pulping digester having a selectively controlled capping valve for opening and closing a chip loading orifice proximate of the top of an interior vessel volume and a steam conduit opening into said interior vessel volume proximate of the bottom thereof, said steam conduit opening having a maximum steam flow rate at least sufficient for full condensation into a maximum chip mass flow rate into said vessel, said method comprising the steps of: (a) charging said interior vessel volume through said capping valve with an initial wood chip mass sufficient to contain and condense ⅓ to ½ of the maximum flow rate of steam flow from said vessel bottom steam conduit, (b) starting an initial steam flow of about ⅓ to ½ of the maximum from said vessel bottom steam conduit, (c) continuing the charging of said vessel interior with chips as said steam flow rate is increased in substantial proportion to the steam condensation capacity of the chip accumulation to a maximum steam flow rate, (d) continuing said maximum steam flow for up to about 3 minutes following completion of chip charging, (e) closing said capping valve when the chip charge is complete and opening a digester relief valve in conduit with the top proximity of said interior vessel volume, (f) charging said digester with a predetermined quantity of delignification chemicals, (g) charging said interior vessel volume with medium pressure steam until said chip charge reaches a predetermined cooking temperature, (h) terminating said medium pressure stream flow, (i) closing said digester relief valve and (j) opening a respective digester blow valve.

9. A method of operating a digester as described by claim 8 wherein the temperature of steam supplied to said interior vessel volume is less than 400° F.

10. A method of operating a digester as described by claim 8 wherein air temperature is monitored within a chip flow channel into said capping valve to terminate steam flow from said vessel bottom conduit responsive to an abrupt temperature increase in said chip flow channel.

11. A method of operating a digester as described by claim 8 said steam flow rate into said interior vessel volume is regulated substantially according to the relationship:

$$\text{Steam Flow, lb/hr}=(\text{Chip Weight, G. T.}+4.79)\div(0.000896),$$

wherein G.T. represents the mass in green tons of chips charged into the digester through the opening.

12. A wood chip pulping digester comprising a vertically elongated pressure vessel having a filler neck opening of reduced sectional area proximate of the vessel top portion, said neck opening being controlled by a capping valve, a chip flow channel for confining a flow of wood chips through said neck opening and past said capping valve, a process steam conduit opening into said vessel proximate of the vessel bottom portion, an air temperature sensor proximate of said chip flow channel for monitoring air temperature within said channel and emitting a signal proportional thereto, a power operated valve in said process steam conduit for terminating steam flow therethrough and a controller for operating said power valve to terminate steam flow in said conduit when the presence of steam in said chip flow channel is detected by said temperature sensor.

13. A wood chip digester as described by claim 12 wherein said controller regulates said steam flow to a rate that is coordinated with a flow of wood chips into said vessel whereby substantially all of said steam flow is condensed by said chip flow.

14. A wood chip digester as described by claim 13 wherein said controller regulates said steam flow substantially according to the relationship:

$$\text{Steam Flow, lb/hr}=(\text{Chip Weight, G. T.}+4.79)\div(0.000896),$$

wherein G.T. represents the mass in green tons of chips charged into the digester through the opening.

* * * * *